US006135695A

United States Patent [19]

Kindem et al.

[11] Patent Number: 6,135,695

[45] Date of Patent: Oct. 24, 2000

[54] METHOD FOR VERTICALLY LIFTING A HORIZONTALLY ARRANGED CYLINDRICAL OBJECT, AND A DEVICE FOR USE IN THE METHOD

[75] Inventors: Bjørn Kindem, Kråkerøy; Egil Thømt, Moss, both of Norway

[73] Assignee: Kvaerner Maritime A.S., Lysaker, Norway

[21] Appl. No.: 09/125,385

[22] PCT Filed: Feb. 18, 1997

[86] PCT No.: PCT/NO97/00051

§ 371 Date: Aug. 18, 1998

§ 102(e) Date: Aug. 18, 1998

[87] PCT Pub. No.: WO97/29988

PCT Pub. Date: Aug. 21, 1997

[30] Foreign Application Priority Data

Feb. 19, 1996 [NO] Norway ..... 960659

[51] Int. Cl.[7] ..... B66C 13/06

[52] U.S. Cl. ..... 414/139.9; 89/1.805; 414/137.9; 414/803

[58] Field of Search ..... 414/137.8, 138.2, 414/138.3, 138.4, 560; 89/1.805; 212/307

[56] References Cited

U.S. PATENT DOCUMENTS

H683 10/1989 Brubaker ..... 89/1.802
4,174,188 11/1979 Brun .
5,577,874 11/1996 Olson .
5,918,306 6/1999 Kristensen et al. ..... 89/1.805

FOREIGN PATENT DOCUMENTS 171446 12/1992 Norway .
171446B 12/1992 Norway .
300369 5/1997 Norway .
2064469 6/1981 United Kingdom .

*Primary Examiner*—Gregory A. Morse
*Attorney, Agent, or Firm*—Birch, Stewart Kolasch & Birch, LLP

[57] ABSTRACT

In a method and a device for vertically lifting a horizontally arranged cylindrical object, especially a rocket (50), from a base (40) by means of one or more lifting yokes (61) which are suspended in a lifting device (70), preferably comprising one or more lifting wires (71) which are suspended from a crane beam (24), the lifting yoke (61) is placed above the object (50) and connected thereto, jacks (62) are provided between the base (40) and the lifting yoke (61), the lifting yoke (61) with the object (50) are lifted up with the jacks (62) from the base (40) to a critical height for the lift, the tension in the lifting wires (71) is increased, thus transferring the weight of the lifting yoke (61) and the object (50) from the jacks (62) to the lifting wires (71), and the lifting yoke (61) with the object (62) are lifted up from the jacks (62) by means of the lifting wires (71).

13 Claims, 4 Drawing Sheets

Figure 1:
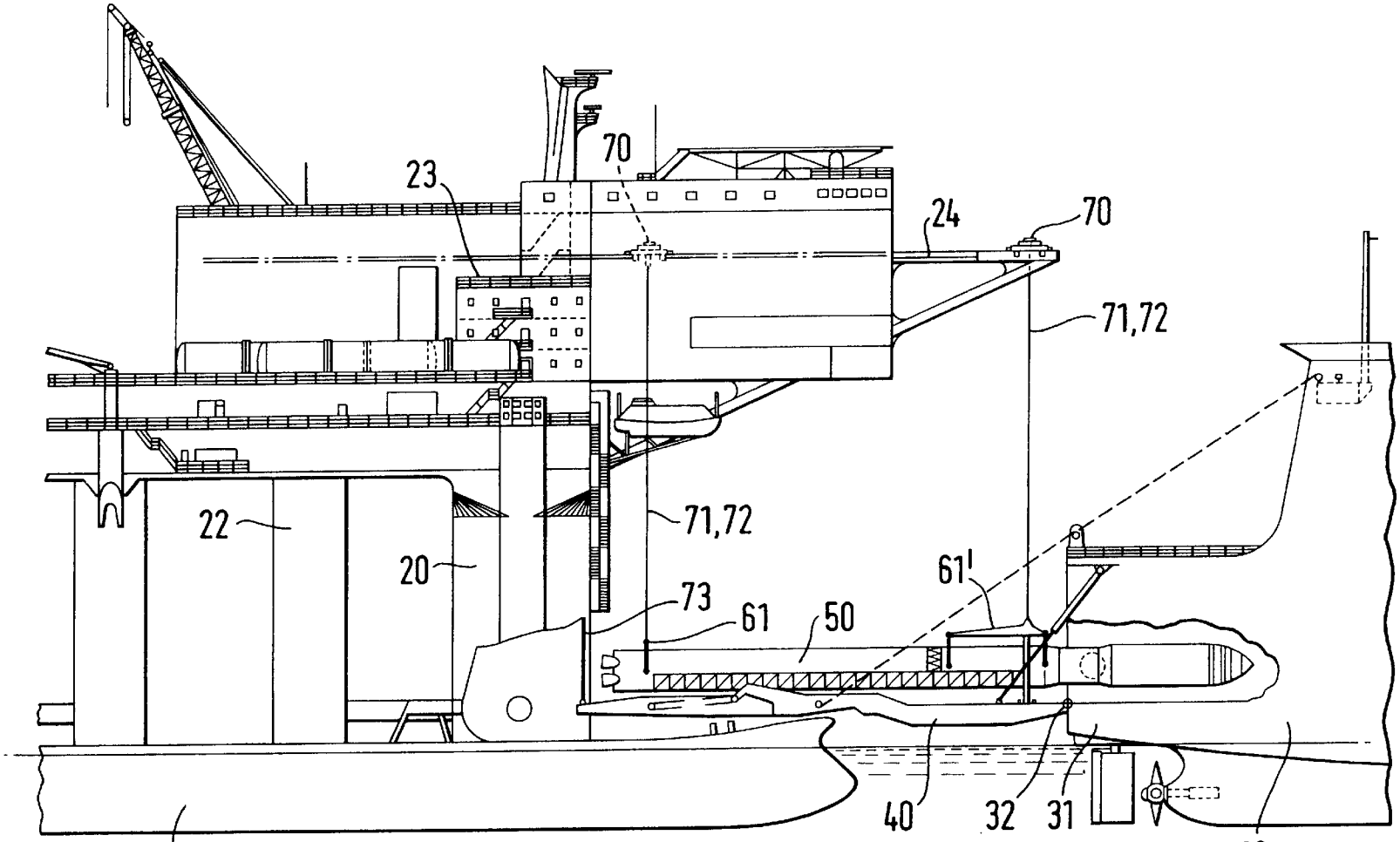

METHOD FOR VERTICALLY LIFTING A HORIZONTALLY ARRANGED CYLINDRICAL OBJECT, AND A DEVICE FOR USE IN THE METHOD

This application is the national phase under 35 U.S.C. §371 of prior PCT International Application No. PCT/NO97/00051 which has an International filing date of Feb. 18, 1997 which designated the United States of America, the entire contents of which are hereby incorporated by reference.

The invention concerns a method for vertically lifting a horizontally arranged cylindrical object, especially a rocket, from a base by means of one or more lifting yokes which are suspended in a lifting device, preferably comprising one or more lifting wires which are suspended from a crane beam.

The invention also concerns a device for use in the method, wherein a horizontally arranged cylindrical object, especially a rocket, is lifted from a base by means of one or more lifting yokes which are suspended in a lifting device, preferably comprising one or more lifting wires which are suspended from a crane beam.

Large rockets for transport of payloads into space may be 50 m or more in length. Such rockets contain a number of sophisticated technical systems, such as mechanical, electrical and optical systems, and both the rocket's technical systems and structural design are highly optimized with regard to weight. On account of this optimization the rockets are principally designed in order to withstand the loads to which they are exposed during launching, while they are only designed for small external stresses, such as stresses generated by wave movement and weather conditions.

The actual rocket consists of several stages and a payload, which, e.g., may be a satellite. The different stages and the payload are built separately and subsequently brought to an assembly location.

Due to the earth's rotation the equator is the most favourable place for launching rockets. However, the assembly and preparation of a large rocket require substantial resources both in the form of expertise and material, and the availability of such resources is best in areas which are not situated at the equator.

Norwegian patent applications 951693, 951694 and 951695 describe the assembly and launch of rockets where the rocket is assembled in a horizontal position on board a vessel, and subsequently brought aboard a transportable floating platform for transport to a launch site and launching. The rocket can thereby be launched at the equator, while at the same time all the technical aids and technical expertise are easily available, since the aids and expertise can be present on board the vessel or platform. The above-mentioned patent applications do not, however, describe how the rocket is transferred from the vessel to the platform.

A vessel and a floating structure, such as a launch platform for a rocket, will normally have different movements in the water. The movements are mainly due to the influence of the waves, and the differences in movement are due to the fact that the vessel and the floating structure have different shapes and masses, and also that the influence of the waves on the vessel and the floating structure will be displaced in time in relation to each other. When objects are transferred between two vessels at sea where the objects are lifted by means of a lifting device on one vessel, this difference in movement is a recognized problem, since the objects can bump against the other vessel and be damaged.

NO-A-171446 discloses a method for vertically lifting a horizontally arranged object from a base by means of a lifting device comprising lifting wires. The method comprises the following stages:

a) jacks 9 are provided for lifting the object;

b) the object is lifted up by the jacks from the base to a critical height for the lift;

c) the tension in the lifting wires is increased, thus transferring the weight of the object from the jacks to the lifting wires;

d) the object is lifted up from the jacks by means of the lifting wires.

The object of the invention is to provide a method and a device for vertically lifting a horizontally arranged cylindrical object, especially a rocket, from a base, where the lift is effected by one or more lifting yokes by means of a lifting device, preferably comprising one or more lifting wires, which lift should not be encumbered with the disadvantage that the difference in movement between the base and the lifting device damages the rocket during the introductory phase of the lift.

The object is achieved according to the invention with a method and a device of the type mentioned in the introduction, characterized by the features which are indicated in the claims.

Thus the invention consists in the object, for example a horizontally extending rocket, being arranged below a lifting yoke, and the lifting yoke being jacked up to a critical height, thus guiding the rocket's movement in relation to the base, whereupon the lifting continues with lifting wires in the known manner.

In this patent application the term "critical height" is understood to mean a minimum lifting height where there is no longer any risk of collision between the object, especially the rocket, and the base, especially a saddle.

Figure 2:
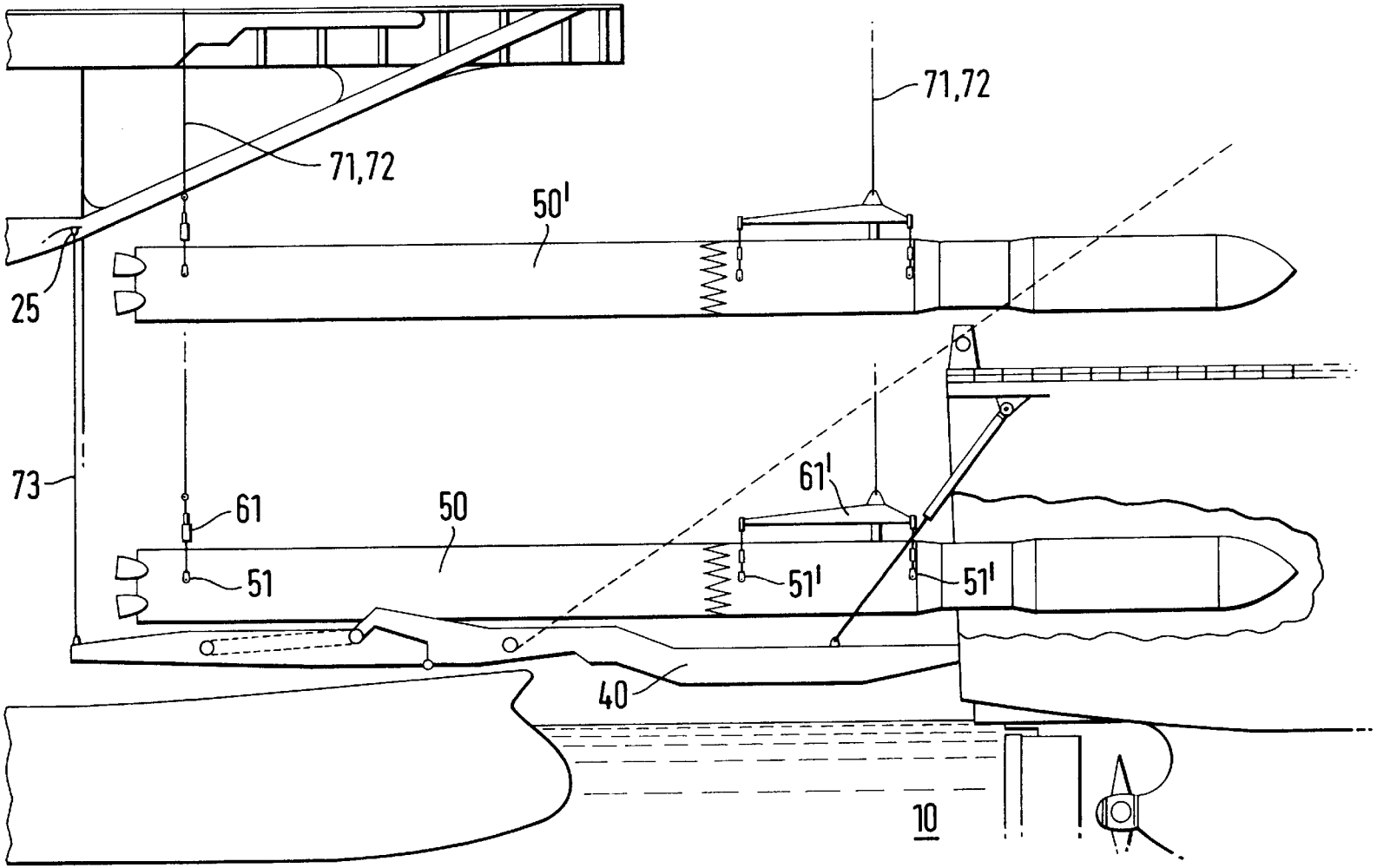
Figure 3:
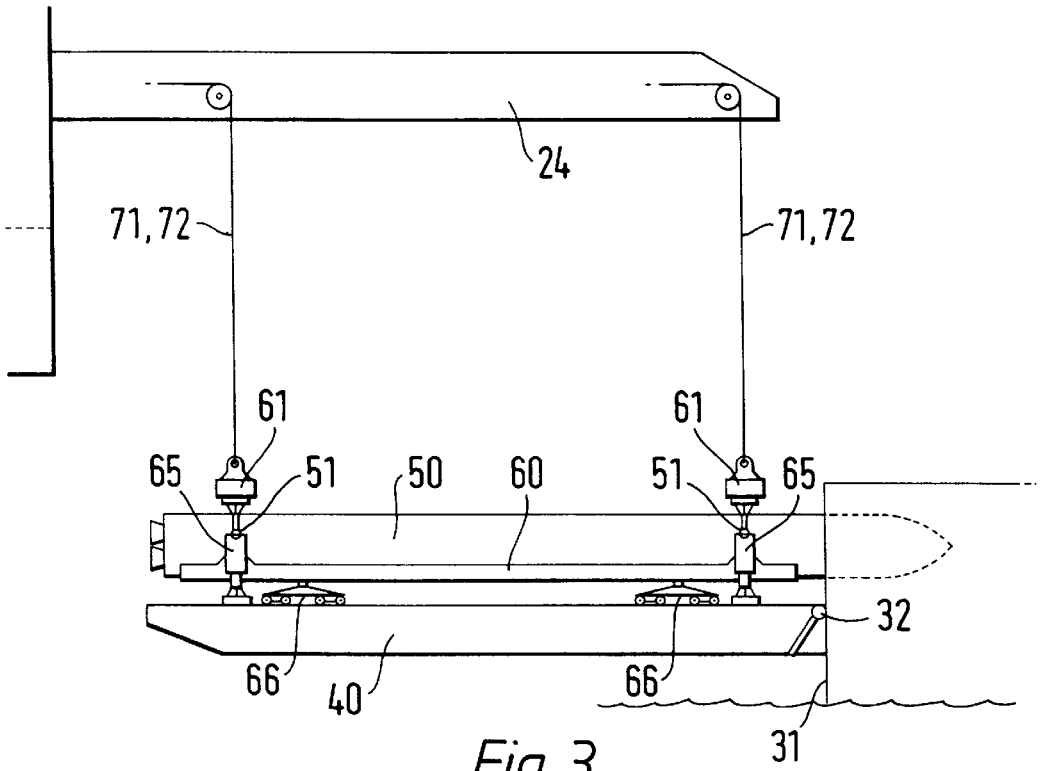
Figure 4:
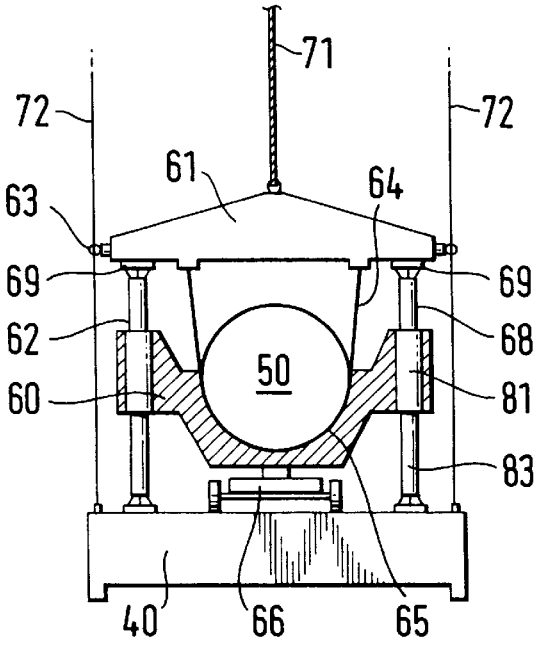
Figure 5:
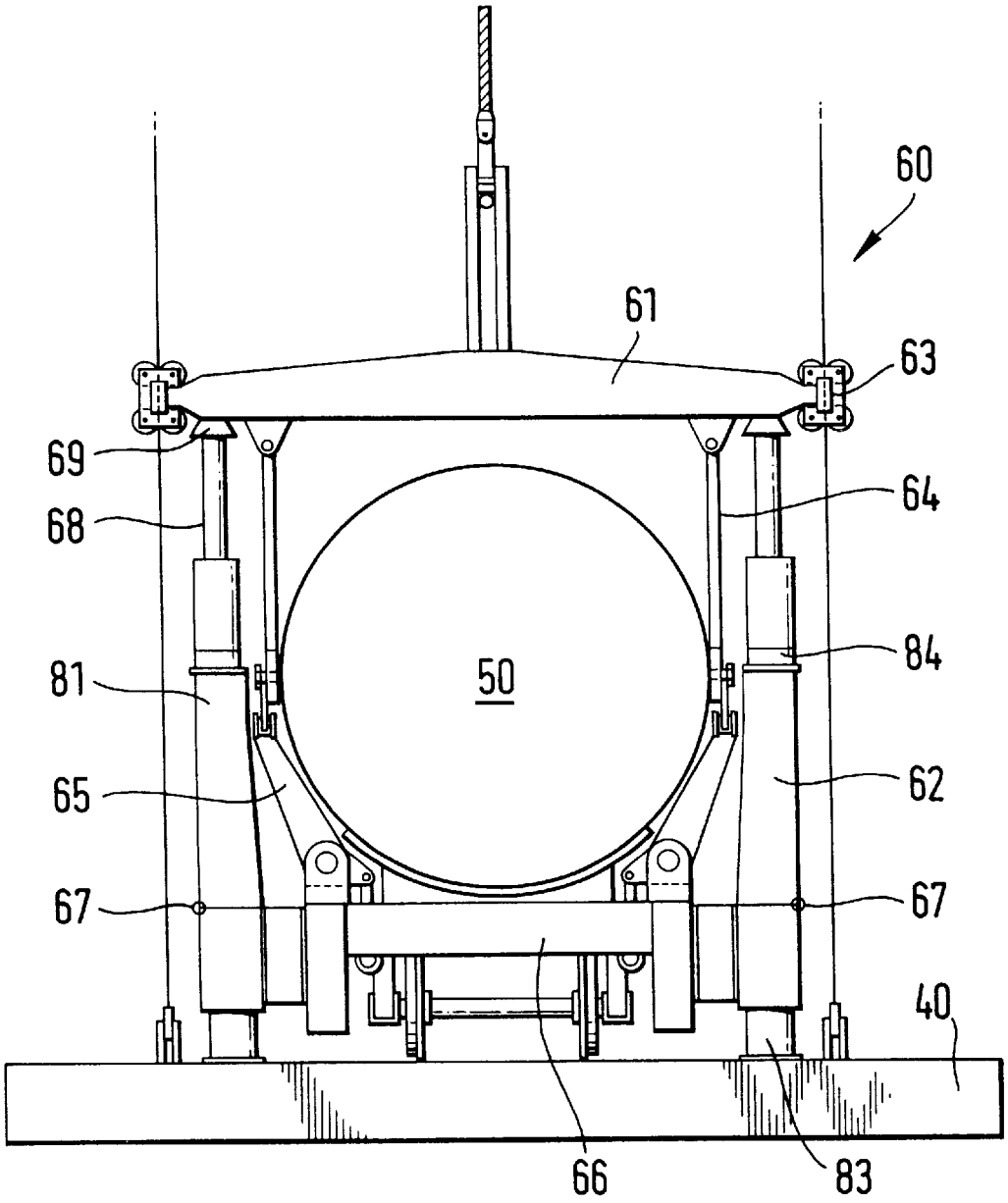

The invention will now be explained in more detail in connection with a description of a specific embodiment and with reference to the drawing, in which FIG. 1 is a side view of a rocket horizontally arranged on a ramp, FIG. 2 shows the rocket in two different positions during a vertical lift, FIG. 3 shows the rocket and the ramp in closer detail, and FIG. 4 shows a lifting yoke and a device for use in lifting, and FIG. 5 shows a second embodiment of a lifting yoke and a device for use in lifting.

The same reference numerals are used for corresponding parts in all the figures.

FIG. 1 illustrates a floating structure 20 with pontoons 21 and columns 22, floating at sea 10. On top of the columns 22 there is provided a deck structure 23 with a crane beam 24. Beside the floating structure there is located a vessel 30, of which only the stern 31 is shown. An elongated ramp 40 is placed in a position projecting out from the vessel 30, so that the ramp 40 is substantially located below the crane beam 24.

The end of the ramp which is located closest to the vessel is pivotally connected to the vessel about a horizontal axis 32, thus enabling the ramp to be rotated in relation to the vessel. The end of the ramp which is located furthest from the vessel 30 is connected to the floating structure 20 by being suspended in vertical securing wires 73 from an attachment point 25 on the floating structure. In this manner a ramp is obtained, one end of which is continuously connected to the vessel 30, and the other end of which has a constant vertical distance from the crane beam 24. The vessel's vertical movement will be transferred to the end of the ramp which is located closest to the vessel, while the floating structure's vertical movement will be transferred to the end of the ramp which is suspended in the wires 73. Thus the ramp forms a far better basis for a vertical lift of an object, in this case a rocket, than, e.g., the vessel's afterdeck.

When a rocket 50 is transferred from the vessel to the floating structure, the rocket is moved entirely or partially out on to the ramp 40 and lifted over to a floating structure by means of a lifting device 70, which in the illustrated embodiment is composed of lifting wires 71 from the crane beam 24.

FIG. 2 illustrates the lifting of the rocket, where the rocket is shown in two positions, a position 50 on the ramp 40 before the lift, and a position 50' where the rocket has been lifted upwards in the direction of the crane beam 24. The rocket is lifted by means of two lifting yokes, a rear lifting yoke 61 in the form of a lifting beam, and a front lifting yoke 61' in the form of a frame. The rear lifting yoke 61 lifts the rocket 50 in two lifting lugs 51, while the front lifting yoke 61' lifts the rocket in four lifting lugs 51'.

FIG. 3 illustrates the rocket 50 and the ramp 40 in closer detail. It can be seen here how the rocket is placed on a device 60 which consists of a longitudinal support structure which in turn is placed on two carriages 66, in the form of bogies. The device 60 has saddles 65 which support the rocket during transport of the rocket to the ramp. In the embodiment illustrated in FIG. 3 the rocket's front and rear sections are lifted by two identical lifting yokes 61, both of which are in the form of lifting beams, for lifting the rocket in two lifting lugs 51.

FIG. 4 is a cross section through the rocket 50, the lifting yoke 61 and the device 60. Apart from the saddle 65 and the carriage 66 the device 60 includes two jacks 62. It also illustrates how the rocket is connected to the lifting yoke by two lifting slings or lifting stays 64.

The jacks 62 are provided as hydraulic jacks with vertical hydraulic cylinders 81 located at the outer edges of the device 60, furthest away from the rocket 50. The piston rods 68 with lifting blocks 69 extend vertically upwards from the hydraulic cylinders 81, and the lifting blocks 69 abut against the underside of the extreme points of the lifting yoke 61. The jacks are further provided with extensible legs 83 in the extension of the cylinders 81 in order to support the jacks and transfer vertical forces from the jacks to the ramp.

FIG. 4 also illustrates two vertical guide wires 72, which extend parallel to the lifting wires 71 from the ramp 40 to the crane beam 24, and are passed through guides 63 in the extreme points of the lifting yoke 61. Before lifting, the guide wires 72 are tightened by means of suitable devices, e.g. jigger winches, to a suitable tension, e.g. 10 tons per wire, so that their potential horizontal movement is very limited.

When attaching the ramp 40 in the floating structure 20, as described with reference to FIG. 1, every effort is made to give the ramp 40 with the rocket 50 the same vertical movement as the floating structure with the crane beam 24 and the lifting wires 71. In spite of this the vertical movements will not entirely coincide, and the critical part of the lift will therefore be the introductory phase where the rocket is lifted from the ramp, when there will be some risk of the rocket bumping against the saddles. The potential problems during the introductory phase of the lift are solved according to the invention by jacking up the lifting yoke 61 with the rocket 50 by means of the jacks 62 to a certain critical height. A continuous and smooth lifting of the rocket 50 from the saddles 65 is thereby achieved, and since the vertical distance between the saddles 65 and the rocket 50 is controlled by the jacks 62, there is no risk of a collision.

After the jacking up has reached the critical height the tension in the lifting wires 71 is increased, thus transferring the weight of the lifting yoke 61 with the rocket 50 from the jacks to the lifting wires, whereupon the lifting continues by means of the lifting wires in the known manner. The piston rods 68 with the lifting blocks 69 are lowered as quickly as possible after the weight has been transferred to the lifting wires, for example by rapid drainage of hydraulic fluid, thus preventing the rocket from bumping against any part of the base or the devices located on the base, such as the piston rods or the lifting blocks, in the event of an inadvertent movement during the continuation of the lift.

The rocket's horizontal movement is kept under control both during the introductory and subsequent phases of the lift by guiding the lifting yoke in the lateral direction by the guide wires 72. The lifting wires 71, guide wires 72 and jacks 65 are all located in the same vertical plane, with the result that the transition from the introductory phase to the subsequent phase of the lift does not entail any change in the position of the points of attack for the vertical forces which lift the rocket.

FIG. 5 illustrates an alternative embodiment of the device 60. A somewhat different design of the saddles 65 is shown here, the contact faces for the rocket being of a slightly different design than in the device 60 illustrated in FIG. 4. Furthermore, the jacks are provided with flexible joints 84 in order to adjust the position of the lifting blocks 69 in relation to the lifting yoke 61. In the device 60 illustrated in FIG. 5 the jacks 62 are further provided with pivot joints 67, thus enabling the jacks to be tilted about a horizontal axis, away from the rocket. After transferring the weight of the lifting yoke 61 with the rocket 50 from the jacks 62 to the lifting wires 71, the jacks can thereby be rapidly tilted away, thus preventing them from being struck by the rocket if it should make an inadvertent movement during the continuation of the lift.

The invention has been described in the above with regard to one specific embodiment. It is obvious, however, that several variations are possible within the scope of the invention. For example, the lifting yoke 61 can be designed in several ways, such as a combination of two or more beams, or a lifting frame. Similarly, it is possible to transfer the weight of the rocket to the lifting yoke in several ways, either with permanently mounted lifting lugs as illustrated, or, e.g., by letting the rocket rest in a cradle of rigid or flexible material, thus permitting the forces to be transferred uniformly from the cylindrical outer side of the rocket to the lifting slings or lifting stays.

Furthermore, the design of the jacks can be varied in several ways, e.g. by using two jacks on each side instead of one. This could be a natural solution in the case where a lifting frame is employed instead of a lifting beam. It is also obvious that the lifting function of the jacks can be achieved by other means than the use of hydraulics, e.g. by means of a screw mechanism. Moreover, it is obvious that the function involving rapid removal of the jacks after the weight of the jacks has been transferred to the lifting wires can also be performed in several ways, e.g. by providing the jacks with drop mechanisms.

The above-mentioned and similar variations, which will be natural for a person skilled in the art, will all lie within the scope of the invention.

What is claimed is:

1. A method for vertically lifting a horizontally arranged object from a base by means of one or more lifting yokes suspended from a lifting device, the lifting device having one or more lifting wires suspended from a crane beam, the method comprising the steps of:

placing the lifting yoke over the object and connecting the lifting yoke thereto;

providing jacks between the base and the lifting yoke;

lifting the lifting yoke with the object suspended thereto with the lifting jacks from the base to a critical height for the lift;

increasing the tension in the lifting wires to transfer weight of the lifting yoke and the object from the jacks to the lifting wires; and lifting the lifting yoke and the object up from the jacks with the lifting wires.

2. The method according to claim 1, wherein the step of increasing the tension further includes the step of lowering or removing the jacks immediately after the weight of the lifting yoke and the object has been transferred to the lifting wires.

3. The method according to claim 1, wherein before the step of lifting with the jacks, the method includes the steps of:

providing guide wires between the base and the crane beam;

tightening the guide wires to a predetermined tension; and guiding the lifting yoke during the steps of lifting with the jacks and increasing the tension in the lifting wires.

4. The method according to claim 3, wherein the method further includes the step of guiding the lifting yoke in the lateral direction by the guide wires during the step of lifting with the lifting wires.

5. A device for lifting a horizontally arranged object from a base with at least one lifting yoke, comprising:

a lifting yoke suspended from a lifting device having at least one lifting wire; and at least one jack for lifting the lifting yoke, with the object suspended thereunder, from a location where the object is located on the base to a critical height for the lift, and wherein the lifting yoke with the suspended object is further lifted from the critical height by the lifting device.

6. The device according to claim 5, wherein the at least one lifting yoke is in the form of a beam having two ends and two jacks are arranged to lift the at least one lifting yoke from the two ends.

7. The device according to claim 5, wherein the at least one lifting yoke is in the form of a frame having opposite corners and the at least one jack is arranged to lift the at least one lifting yoke from the opposite corners.

8. The device according to claim 5, wherein said at least one jack is hydraulic and includes a valve for rapid drainage of hydraulic fluid, said at least one jack being capable of being immediately lowered after weight of the 5lifting yoke and the object is transferred to the lifting wires of the lifting device.

9. The device according to claim 5, wherein said at least one jack includes a rocker device for tilting the at least one jack out of the operative position, said at least one jack being capable of being tilted to a side thereof immediately after weight of the lifting yoke and the object is transferred to the lifting wires of the lifting device.

10. The device according to claim 5, further comprising a support for supporting the object on the base, said at least one jack being connected to the support.

11. The device according to claim 10, further comprising a transport structure for movably supporting the support and the at least one jack.

12. The device according to claim 1, wherein the horizontally arranged object is a rocket.

13. The device according to claim 5, wherein the horizontally arranged object is a rocket.

* * * * *